United States Patent [19]

Brignoli

[11] 3,945,237

[45] Mar. 23, 1976

[54] HIGH SPEED HAMMER FORGING MACHINES

[76] Inventor: Silvio Brignoli, Kanton Tessin, CH-6981 Monteggio, Switzerland

[22] Filed: Dec. 23, 1974

[21] Appl. No.: 535,829

[52] U.S. Cl. ..... 72/402; 72/403; 72/452

[51] Int. Cl.[2] ..... B21J 7/32

[58] Field of Search ..... 72/402, 403, 452, 76

[56] References Cited

UNITED STATES PATENTS

| | | | |
|---|---|---|---|
| 1,617,890 | 2/1927 | Abbey | 72/402 |
| 2,986,051 | 5/1961 | Appel | 72/402 |
| 3,146,642 | 9/1964 | Kralowetz | 72/402 |
| 3,263,474 | 8/1966 | Pentland | 72/402 |

FOREIGN PATENTS OR APPLICATIONS

| | | | |
|---|---|---|---|
| 948,932 | 9/1956 | Germany | 72/402 |

*Primary Examiner*—Lowell A. Larson
*Attorney, Agent, or Firm*—Ernest F. Marmorek

[57] ABSTRACT

In a high-speed hammer, precision forging machine the hammers are radially oriented with respect to the axis of the workpiece and are arranged in a plurality of opposed pairs. The hammers are positively coupled to each other by gearing. Displacement elements such as pairs of wedges that are longitudinally positioned between each hammer and its respective die holder so that, during the simultaneous movement of the dies towards the workpiece, an additional stroke movement is achieved. Mechanical, hydraulic, pneumatic or electrical means may be used to control the movement of the displacement elements.

15 Claims, 8 Drawing Figures

FIG.6
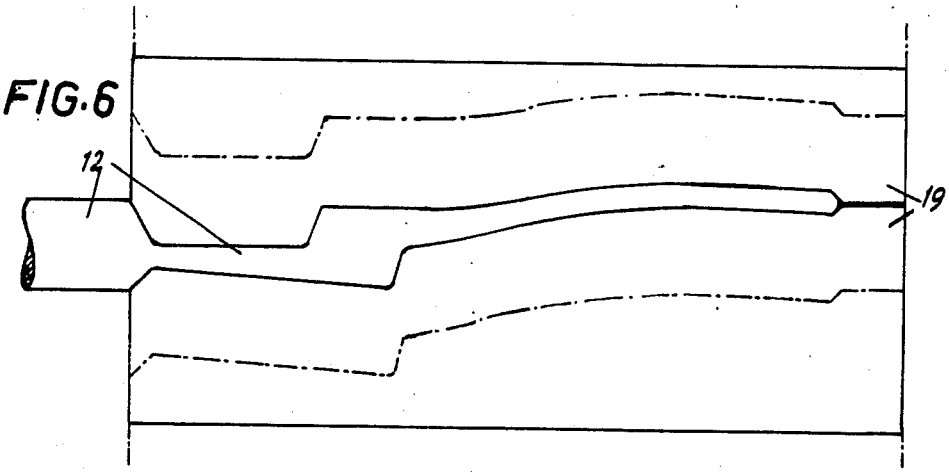
FIG.7
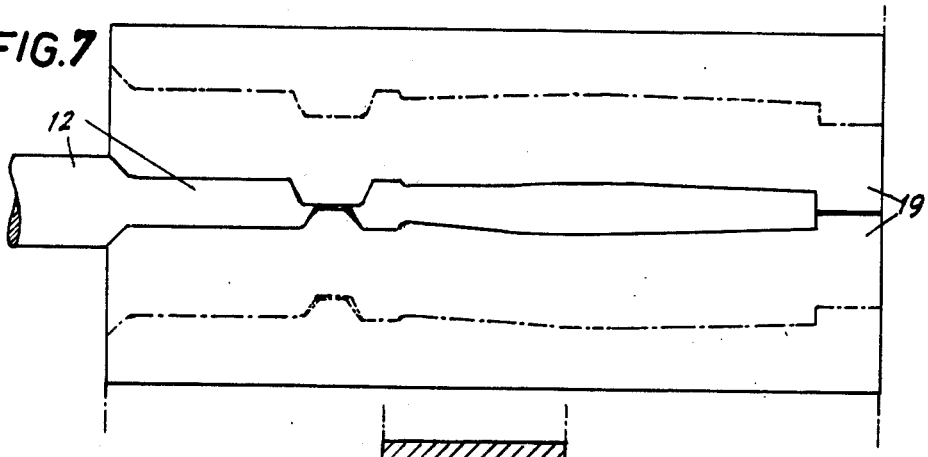
FIG.5
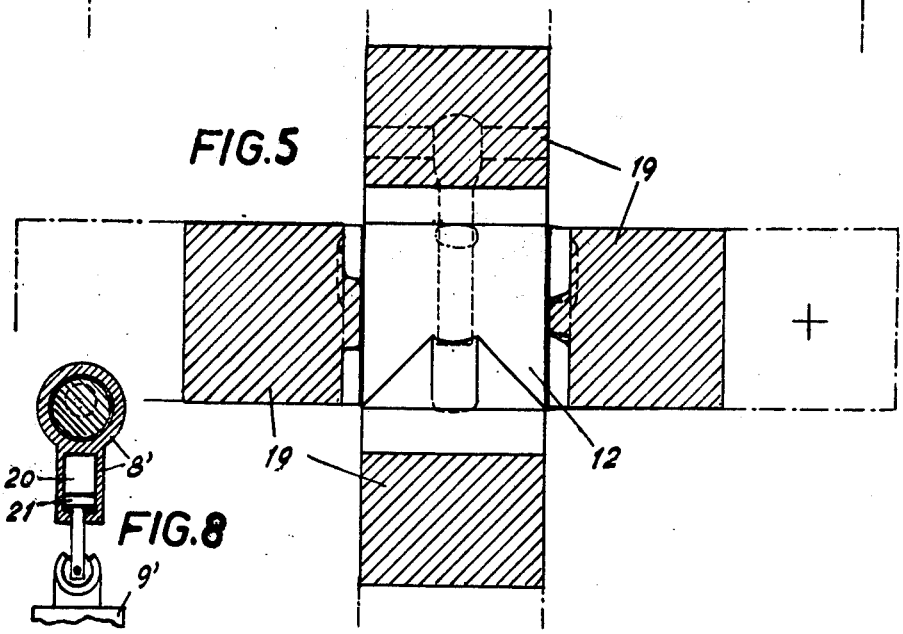
FIG.8

HIGH SPEED HAMMER FORGING MACHINES

BACKGROUND OF THE INVENTION

This invention relates generally to the art of metal forming and more particularly to high-speed hammer, precision forging machines.

DESCRIPTION OF THE PRIOR ART

The present invention provides a high-speed hammer, precision forging machine having several advantages over such machines known hitherto. The present invention permits burr-free forging of the workpieces, provides a larger working stroke, and avoids the lateral thrust components upon the guide tracks which occur in the case of eccentric drive systems. Apart from the eccentric stroke of the hammers, an additional displacement of the die holders in relation to the hammers is provided to increase the die strokes. Moreover optimum cooling of the electric motors, the eccentric shafts, the bearings therefor and the hammers is taken into consideration. The resulting scale can fall freely downwards out of the internal space of the machine housing.

SUMMARY OF THE INVENTION

The present invention provides a high-speed hammer forging machine having at least four high-speed hammers that are radially distributed over the periphery of the workpiece (workpiece introduction axis) and which are driven by eccentric shafts. The hammers are guided in a known manner in housing covers by means of the holders receiving the dies, in the machine housing, with lateral spacing from the housing being provided, for the purpose of achieving the above-mentioned advantages. In order to produce burr-free forgings possible mutually opposed high-speed hammers in each case are controlled in alternate hammer-blow sequence in relation to other pairs of hammers. The electric motors with the eccentric shafts are in positive rotational connection with one another for synchronization purposes through miter or the lie gearings in the sense of synchronisation, which are installed at right angles, that is transversely, of the die longitudinal axis or workpiece introduction axis with one another in the internal space of the housing. The hammers are further connected with one another and with the holders, by means of mechanical, pneumatic, hydraulic or electrically controlled displacement elements resiliently in relation to the stroke axes in such a way that, apart from the forging stroke movements, all die holders with their dies are simultaneously displaceable towards the workpiece (incision operation) during the forging operation to achieve an additional stroke movement.

BRIEF DESCRIPTION OF THE DRAWINGS

The invention will be explained in greater detail hereinafter by an example of a form of embodiment with a variant which are illustrated in the accompanying drawings, wherein:

FIG. 5 schematically illustrates the die positions during the incision operation;

FIGS. 6 and 7 show, from two sides, an example of a form of a workpiece forged with the dies; and FIG. 8 illustrates in partial section alternative means for accomplishing displacement between hammer and die holder.

DESCRIPTION OF THE PREFERRED EMBODIMENTS

Figures 1, 2, 3, 4:
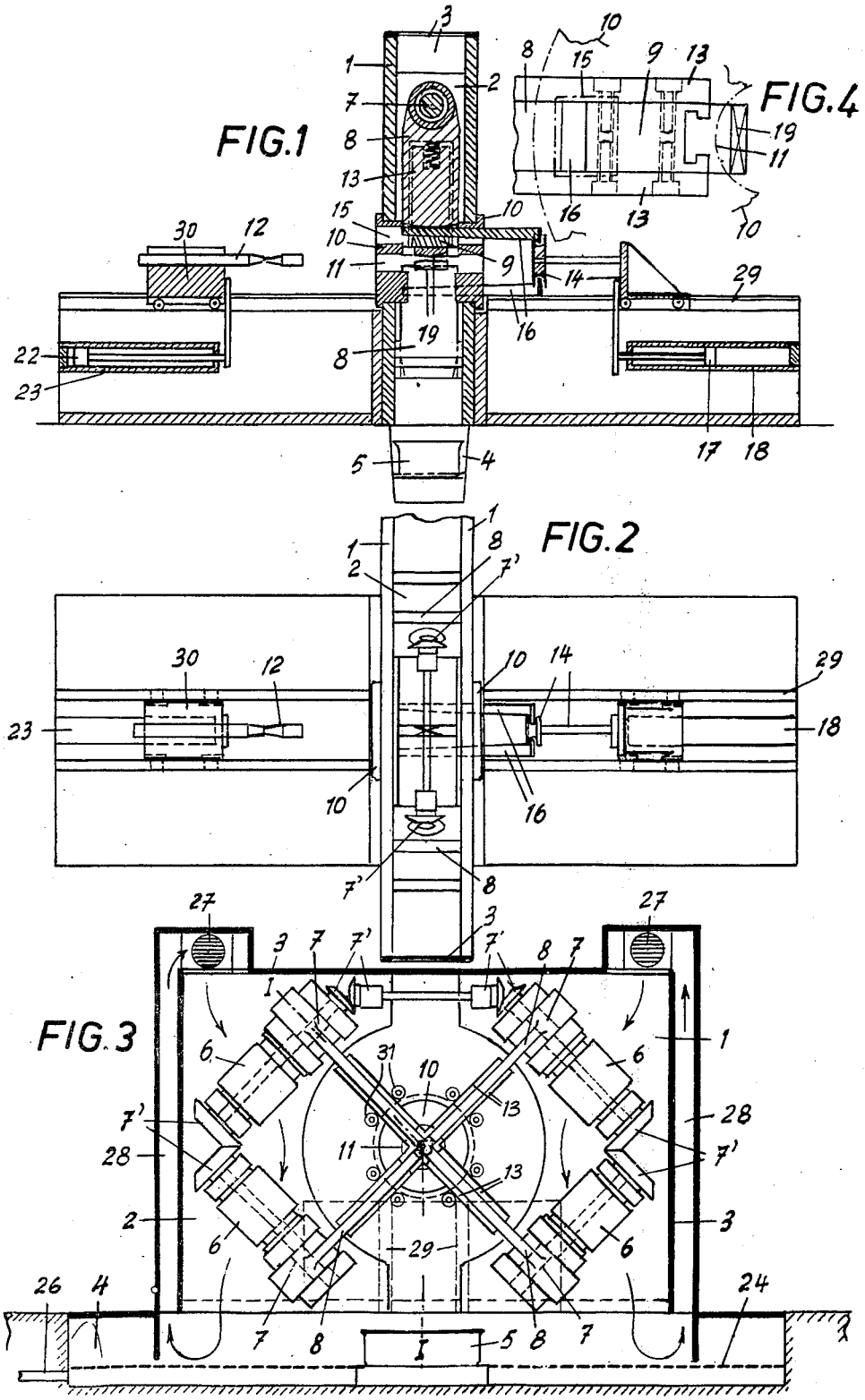
FIG. 1 is a sectional, elevational view of one embodiment of the forging machine comprising the present invention taken along section line I — I in FIG. 3.
FIG. 2 is a plan view of the structure shown in FIG. 1.
FIG. 3 is an end elevational view, partially in section, of the interior of the housing.
FIG. 4 fragmentarily and in phantom outline illustrates a detail of the present invention.

In the drawings, the high-speed hammer precision forging machine comprises a housing 1 consisting preferably of welded armour plates, with forge internal spaces 2 situated therein and enclosed by a housing frame 3. The under side of the housing 1 remains open, facing an oil sump 4 and a scale collecting vessel 5. The electric motors 6, the eccentric shafts 7 with their bearings and the forging hammers 8 are installed in the internal spaces 2. The motors 6 and the eccentric shafts 7 together with miter gearings 7' or similar gearings which serve for the synchronisation of the electric motors 6, are installed at right angles, that is transversely of the longitudinal axis of the die (workpiece introduction axis). This arrangement renders possible a greater forging stroke of the hammers 8 than hitherto and also provides for the substantial prevention of the lateral thrust components, occurring in eccentric drive systems, upon the die holder guides (not shown) of known construction, which die holder guides are situated at the ends in the die holders 9 and the confronting housing covers 10. The housing covers 10 have central introduction openings 11 for the workpieces 12 to be forged. The hammers 8 are resiliently connected in the stroke directions with the die holders 9 through a U-shaped linkage 13. Each U-shaped linkage 13 is preferably guided, on both sides thereof, by means of a pair of rollers 31 which are disposed in the spaces 2 and which are rotatably mounted on and extend from the rear wall to the front wall. Between the hammers 8 and the holders 9 there are installed wedge-type displacement elements, for example such as are designated by the reference characters 16 in FIGS. 1 and 2 which are longitudinally displaceable and coupled positively with one another at one end by means of cross member 14, and which follow the stroke movements of the hammers 8. The displacement elements or wedges 16 pass through apertures 15 situated in the covers 10. The displacement elements can be wedges 16 (FIG. 1) and the catch cross member 14 can be controlled, for example as shown in FIGS. 1 and 2, pneumatically or hydraulically with a piston 17 and a cylinder 18 or electrically, on a rollway 29 so that the hammers 8 and their die holders 9 are displaceable resiliently away from and towards one another in the stroke axis and in the direction of an additional stroke movement of the dies 19 even during the forging action, for the simultaneous feed movement of all dies 19 to the workpiece or forging 12 introduced into the machine. At least four hammers 8 with the associated holders 9 and dies 19 replaceably seated in the holders 9 are provided, and each two mutually opposed hammers 8 act in pairs, in alternate hammer-blow sequence in relation to other pairs of hammers, upon the workpiece 12 by means of the dies 19, thus preventing burr formation on the workpiece. By the achievement of an enlargement of the forging stroke of the hammers 8 and the additional stroke movement of the holders 9 by means of the displacement elements 16, the use of longer and larger dies 19 than hitherto is rendered possible, with consideration of greater die depths.

In place of wedge-type displacement elements 16 the resilient axial shift between hammer 8' and holder 9' can take place according to FIG. 8 pneumatically or hydraulically by means of a cylinder 20 and a piston 21 in the hammer 8' or equally in another electrical manner, in that for example a synchronous motor with a displacement spindle can be installed in the hammer itself.

The workpiece 12 can be fed to the dies 19 from stock by means of a feeder device 30 on the rollway 29. The feeder device 30 may be controlled pneumatically or hydraulically with piston 22 and cylinder 23, or even electro-mechanically. The forging heat is achieved for example with an electric induction plant directly before the entry of the forging 12 into the machine.

The scale collecting vessel 5 is situated in the oil sump 4. Reference character 24 represents an oil filter and reference character 26 designates schematically an oil circulation conduit, in which there is installed a circulating pump (not shown). Fans 27 situated above the internal spaces 2 of the housing 1 ensure an intensive air cooling of the electric motors 6, the eccentric shafts 7, the miter gearings 7', bearings, hammers 8 and their holders 9, the cooling air at the same time cooling the oil in the sump 4, then rising through passages 28 to the fans 27 again, to recommence the cycle. The circulating oil and leakage oil are constantly filtered by the filter 24.

Apart from the advantages already mentioned, the precision forging machine, as described, achieves maximum-precision working of workpieces fed fully automatically from the billet magazine, a tenfold life of the dies in comparison with dies hitherto, a saving of material due to elimination of the burr and thus the elimination of several operations such as stamping, deburring and milling, combined with an improvement of quality of the forging obtained, from simple to the most complicated shaping.

If the stroke of the eccentric shafts 7 is for example 50 mm., then the additional stroke movement of the holders 9 to the hammer 8 is 25 mm., which corresponds to the die depth. This stroke displacement with the aid of the displacement elements in relation to the workpieces 12 may be seen from FIG. 5. It serves thus for the simultaneous infeed of all dies 19.

I wish it to be understood that I do not desire to be limited to the exact details of construction shown and described, for obvious modifications will occur to a person skilled in the art.

Having thus described the invention, what I claim as new and desire to be secured by Letters Patent, is as follows:

1. A high-speed precision hammer machine for forging a workpiece, comprising a housing forming an inner chamber; at least four hammers arranged in opposed pairs in said chamber and distributed radially around a passage along which the workpiece advances through said chamber; die holder means guiding said hammers for radial movement toward and away from a workpiece in said passage; means for connecting each hammer with an associated die holder means; dies held by the respective die holder means; a plurality of eccentric hammer drive shafts arranged in said chamber and extending transverse of said passage radially spaced therefrom, said shafts being arranged in two pairs, the shafts of each pair extending parallel to one another and at right angles to the shafts of the other pair; drive means for said shafts, including a plurality of motors each in axial alignment with one of said shafts; means for providing positive rotational connection of said shafts with one another; means for effecting simultaneous radially inward movement of the hammers of each pair in alternation with similar movement of the hammers of the other pair; forging stroke adjusting means displaceable longitudinally of said passage and interposed between each hammer and the associated die holder means thereof for effecting simultaneous radial shifting of said die holder means and their dies towards and away from said passage during the forging operation; and means for controlling the displacement of said adjusting means.

2. The forging machine according to claim 1, wherein said adjusting means comprise longitudinally moveable pairs of wedges, and a cross member connecting said wedges in each said pair.

3. The forging machine according to claim 2, wherein there is further included a rollway for supporting said wedges and cross members during back and forth movement thereof.

4. The forging machine according to claim 1, wherein said means for connecting said hammers and said die holder means are cylinders and pistons.

5. The forging machine according to claim 4, wherein said cylinders and pistons are pneumatic.

6. The forging machine according to claim 4, wherein said cylinders and pistons are hydraulic.

7. The forging machine according to claim 1, wherein said adjusting means comprise synchronous motors in said hammers.

8. The forging machine according to claim 7, wherein said means for connecting said hammers and said die holder means are spindles.

9. The forging machine according to claim 1, wherein said chamber of said housing includes means for circulating cooling air and wherein there is further included an oil sump over which the cooling air sweeps.

10. The forging machine according to claim 1, wherein there is further included a feed device and a rollway for supporting said feed device whereby the workpieces are feedable to the dies from stock.

11. The forging machine according to claim 1, wherein said drive means for said eccentric shafts comprise gear means.

12. The forging machine according to claim 11, wherein said gear means are miter gears.

13. The forging machine according to claim 1, wherein said means for controlling said adjusting means are mechanical.

14. The forging machine according to claim 1, wherein said means for controlling said adjusting means are pneumatic.

15. The forging machine according to claim 1, wherein said means for controlling said adjusting means are hydraulic.

* * * * *